US008479337B1

(12) United States Patent
Morris

(10) Patent No.: US 8,479,337 B1
(45) Date of Patent: Jul. 9, 2013

(54) WHEELCHAIR BOUND PERSON'S RIDING LAWNMOWER MOUNTING APPARATUS

(71) Applicant: Daniel Lewis Morris, Parrish, FL (US)

(72) Inventor: Daniel Lewis Morris, Parrish, FL (US)

( * ) Notice: Subject to any disclaimer, the term of this patent is extended or adjusted under 35 U.S.C. 154(b) by 0 days.

(21) Appl. No.: 13/694,466

(22) Filed: Dec. 5, 2012

(51) Int. Cl.
*E01D 19/00* (2006.01)

(52) U.S. Cl.
USPC ..... 14/71.1; 14/69.5

(58) Field of Classification Search
CPC ..... E01D 18/00
USPC ..... 14/69.5, 71.1, 73.1; 414/137.1–143.2
See application file for complete search history.

(56) References Cited

U.S. PATENT DOCUMENTS

| | | | | |
|---|---|---|---|---|
| 3,936,898 | A | 2/1976 | Poe | |
| 4,630,709 | A | 12/1986 | Taylor | |
| 4,807,317 | A | 2/1989 | Quinn et al. | |
| 5,214,817 | A | 6/1993 | Allen | |
| 5,454,196 | A * | 10/1995 | Gaines et al. | 52/183 |
| 5,870,788 | A * | 2/1999 | Witkin | 14/69.5 |
| 6,526,614 | B2 | 3/2003 | Anderson et al. | |
| 7,241,078 | B2 * | 7/2007 | Surges | 405/220 |
| 7,571,507 | B2 | 8/2009 | Holicki | |
| 7,607,186 | B1 * | 10/2009 | Mitchell | 14/69.5 |
| D621,959 | S * | 8/2010 | Klockler | D25/62 |
| 2008/0093176 | A1 * | 4/2008 | Rosenthal | 187/241 |
| 2009/0269175 | A1 | 10/2009 | Rose et al. | |
| 2009/0300860 | A1 * | 12/2009 | Campbell | 14/72.5 |
| 2010/0066111 | A1 | 3/2010 | Fritsche et al. | |
| 2010/0146871 | A1 * | 6/2010 | Carson | 52/79.6 |
| 2013/0055511 | A1 * | 3/2013 | McGivern et al. | 14/69.5 |

OTHER PUBLICATIONS

Special Ramp enabling the disabled to board a craft, Bernard Bouchard, #: FR2546497 (A1), Publication Date: Nov. 30, 1984
Modular ramp, Rodney Philpin, GB 2 362 630 A, Publication Date: Nov. 28, 2001.
Rearrangeable Interconnectable System for Handicap Ramps and Platforms, Robert D. Brock, WO 2009/126869 A 2, Publication Date: Oct. 15, 2009.
Recreational Vehicle Portable Deck, Sonny Carson, WO 2005/113916 A2, Publication Date: Dec. 1, 2005.
Modular Platform, Walkway or Ramp, Trevor, Ross Suggate, WO 2004/003312 A1, Publication Date: Jan. 8, 2004.

* cited by examiner

*Primary Examiner* — Raymond W Addie
(74) *Attorney, Agent, or Firm* — John J. Welch, Jr., Esq.

(57) ABSTRACT

A wheelchair bound person's riding lawnmower mounting apparatus being a rectangularly shaped platform support unit having heightwise adjustable support leg units held within laterally positioned leg compartment components welded to the support unit and atop of which there is to be found a rectangularly shaped mounting platform and connectable to which support unit there are arched support railings as well as a rectangularly shaped mounting ramp unit affixed to which is a downwardly extending ramp plate unit fittable into L-shaped lipping welded to the mounting platform together with the support unit and ramp unit also each having wheel assembly units affixed to the bottom portions of each so as to facilitate moving the support unit and ramp unit, when dissassembled and not in use, to a convenient storage site.

6 Claims, 13 Drawing Sheets

WHEELCHAIR BOUND PERSON'S RIDING LAWNMOWER MOUNTING APPARATUS

PRIOR OR PARENT APPLICATIONS

Figure 1:
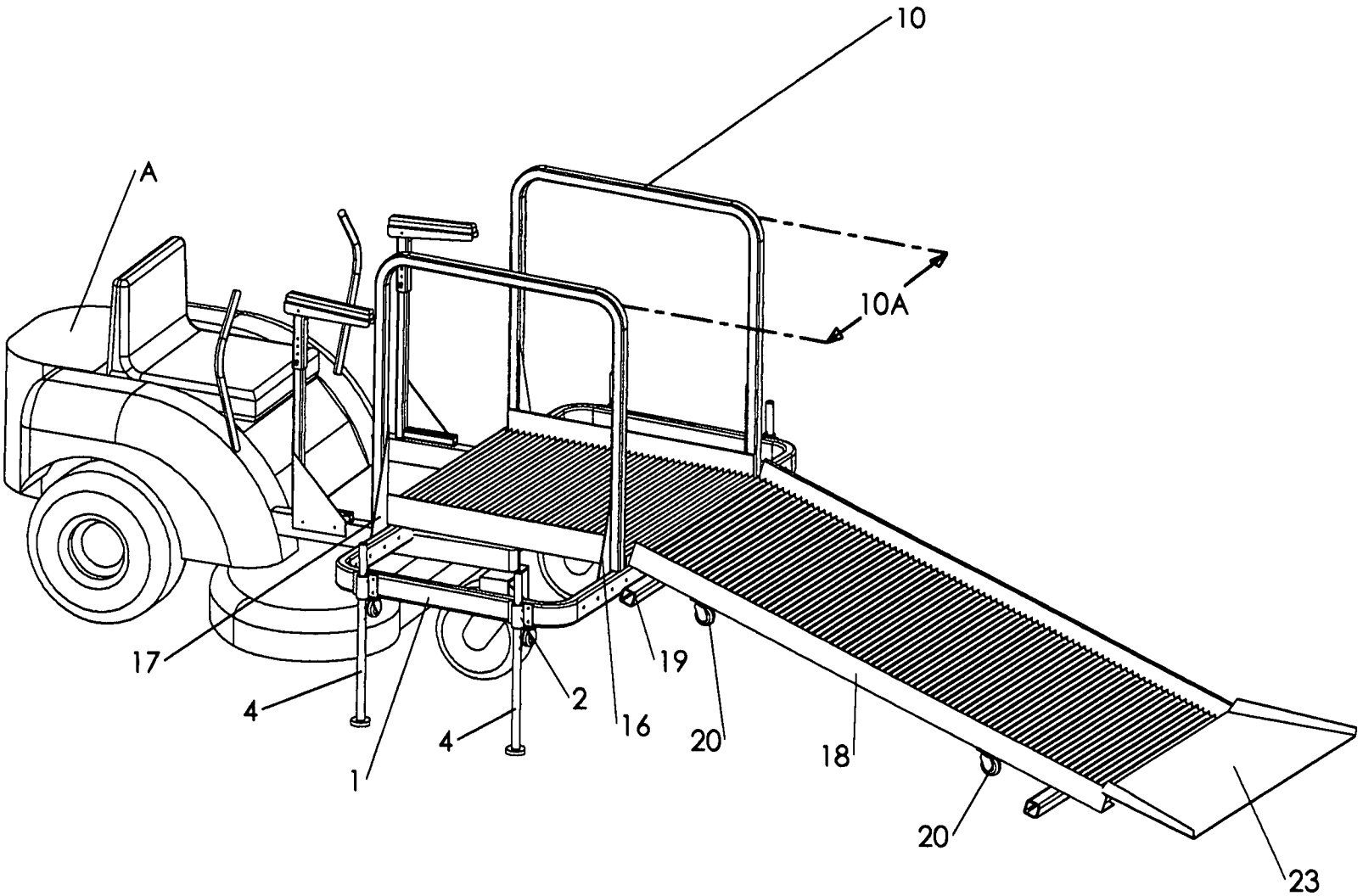

The invention is not the subject of any prior or parent applications.

FEDERALLY SPONSORED RESEARCH AND DEVELOPMENT

The invention is not the subject of any federally sponsored research and development.

BACKGROUND OF THE INVENTION

1. Field of the Invention

The invention relates to devices for facilitating access to riding lawnmowers.

2. Related Art

The herewith submitted Information Disclosure Statement references art that relates to but which does not however anticipate the invention.

A BRIEF DESCRIPTION OF THE INVENTION

The invention is characterized by the presence of a flat, rectangularly shaped platform support unit that is supported by each of four elongated laterally situated leg units. The platform support unit, when, in use, is positioned on such leg units at a height sufficient to enable the placement of a riding lawnmower, more specifically a zero turn lawnmower, partially beneath the platform unit. Each leg unit is heightwise adjustable by way of removal, from holes in each, of a cotter pin insertable one each into a pair of holes in each of four laterally positioned leg compartments with each such pair of holes being concentric with the holes in each of the leg compartments being laterally affixed to the platform support unit. Removal of such pins from such compartment holes and such leg unit holes results in a lowering of the platform support unit to virtually ground level to facilitate disassembly of the invention for storage purposes when not in need of use by a wheelchair bound person when seeking to safely and conveniently mount such a lawnmower and later dismount the lawnmower as well. Four wheel assembly units affixed to a bottom portion of the support platform unit facilitate its removal from a mounting location to a storage site. There are two laterally positioned arched rail units attached to the support unit for the purpose of enabling a wheelchair bound user of the invention to gain support initially with his/her hands when disembarking from a wheelchair atop the mounting platform which is located atop the support unit so as to safely mount the lawnmower as well as to so safely also gain support when seeking to reaccess the wheelchair upon a dismounting from the lawnmower. Finally, a ramp unit with breadth a bit less than the width of the distance as between the rail units so attached to the mounting platform is affixed via a downwardly inclined ramp plate unit, affixed at the top portion of the ramp unit, that fits into L-shaped lipping affixed to the mounting platform, when the bottom edge of the ramp unit is resting on the ground so as to thereby facilitate a person's then driving a motorized wheelchair from ground level up to the level of the mounting platform. Four wheel assembly units affixed to the bottom portion of the ramp unit also serve to facilitate its removal from a mounting location to an ultimate storage site. Finally, the various components of the invention are all typically metallic in nature.

OBJECTS OF THE INVENTION

It is very difficult if, indeed, virtually impossible for wheelchair bound persons to access a riding lawnmower. The invention serves to greatly facilitate such access. In such a respect, the invention notably helps to provide a more level playing field, so to speak, as regards the matters of any such mounting and dismounting of such a lawnmower, as between such wheelchair bound persons and their non-wheelchair bound counterparts. Such a providing of a more level playing field, as it were, is accomplished with resort to utilization of the invention by way of a facilitation of a mounting and also, later, dismounting from above the lawnmower unit rather than as would need to be done, if at all, without resort to utilization of the invention namely, from aside the unit. It is also of great importance that such facilitation be so accomplished as safely as possible. A stop shield feature of the invention together with laterally positioned arched support railings greatly accommodate this safety concern.

In light of the foregoing, it is respectfully submitted, that the invention is not only new and unique but also unquestionably useful.

A DESCRIPTION OF THE DRAWINGS

Figure 2:
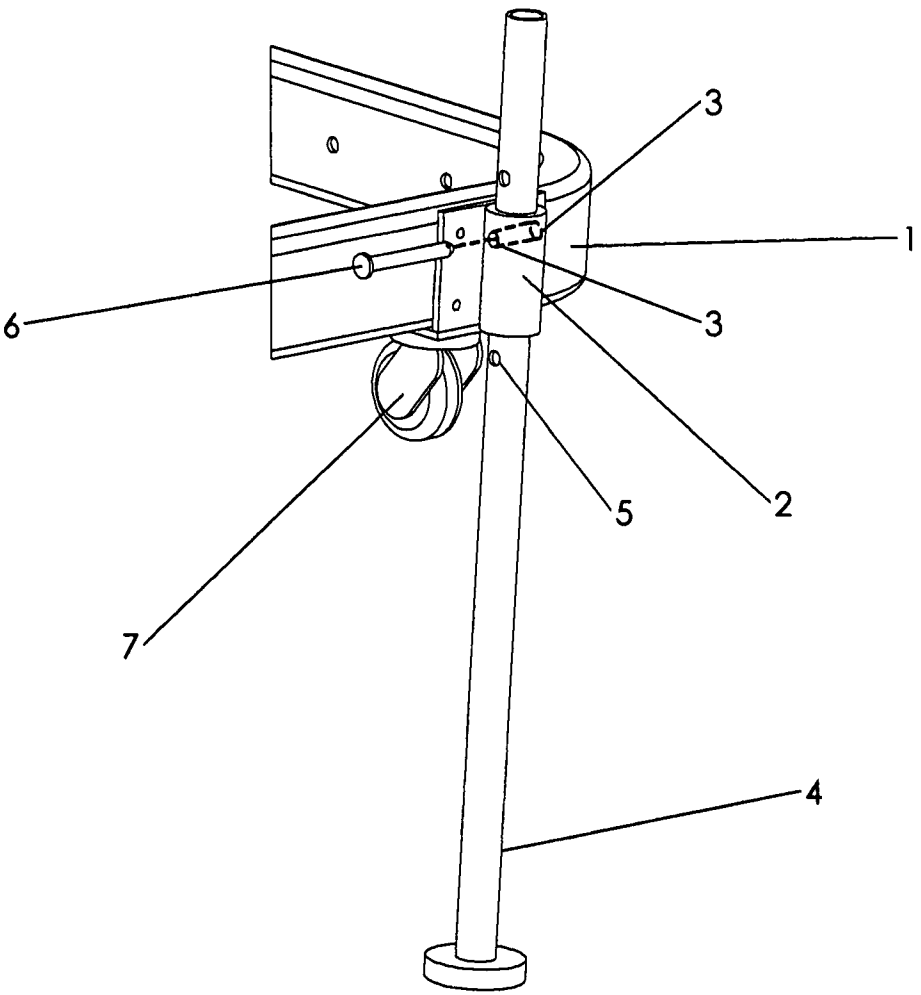
Figure 3:
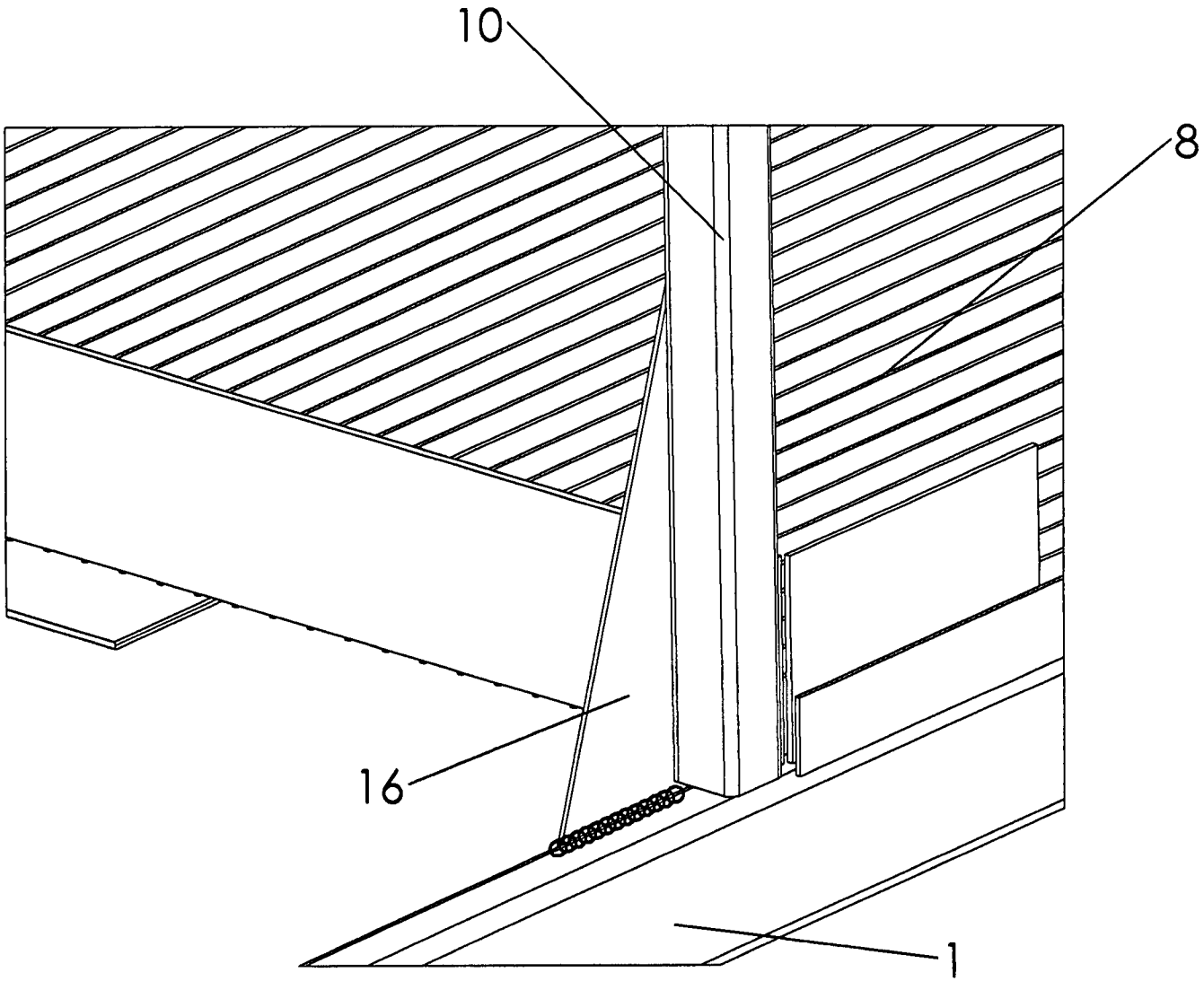

1. FIG. 1 shows the fully assembled invention in apposition to a riding lawnmower.
2. FIG. 2 in an isolated view shows a support leg in apposition to a cotter pin and a leg compartment component.
3. FIG. 3 shows in isolated view a portion of the second embodiment of the invention with a portion of the support unit thereof welded to support railing bracing thereof.

Figure 3A:
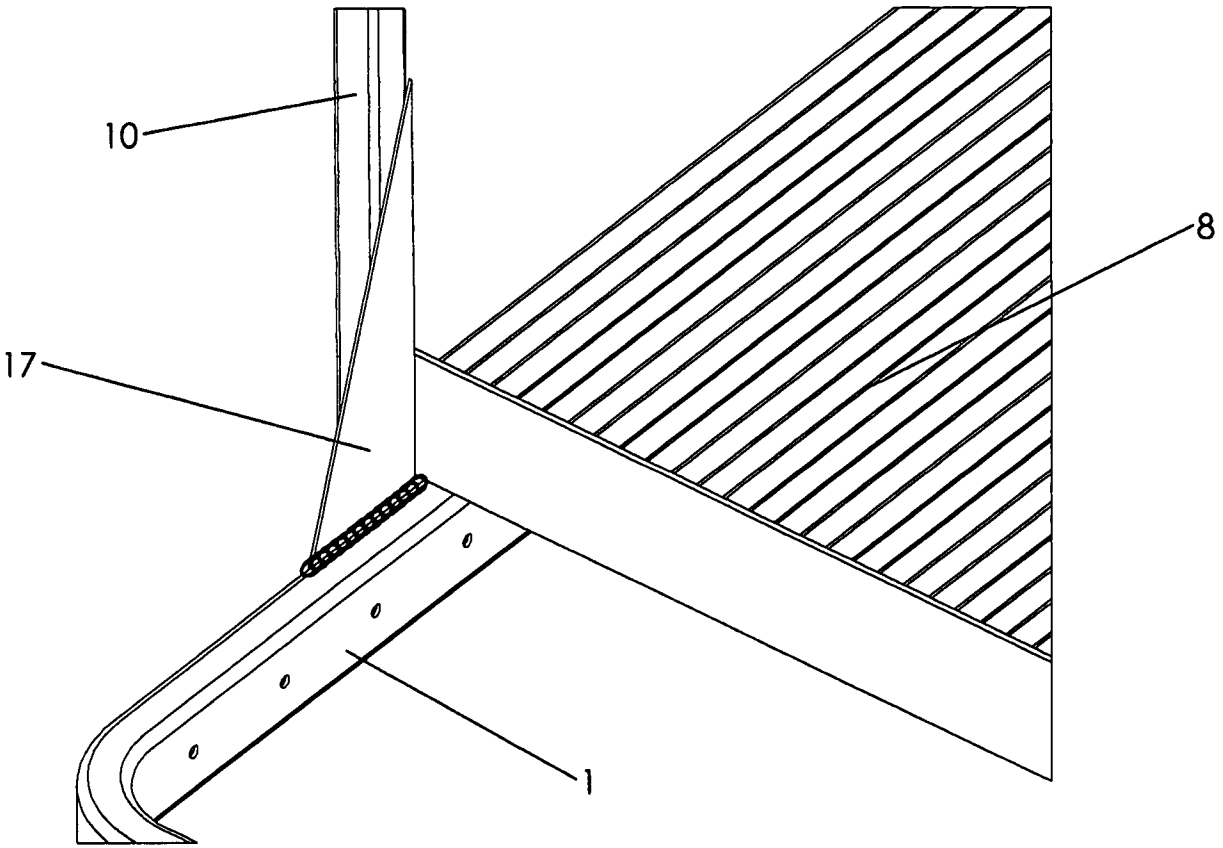

3A. FIG. 3A shows in isolated view another portion of the second embodiment of the invention with another portion of the support unit thereof welded to other support railing bracing thereof.

Figure 4:
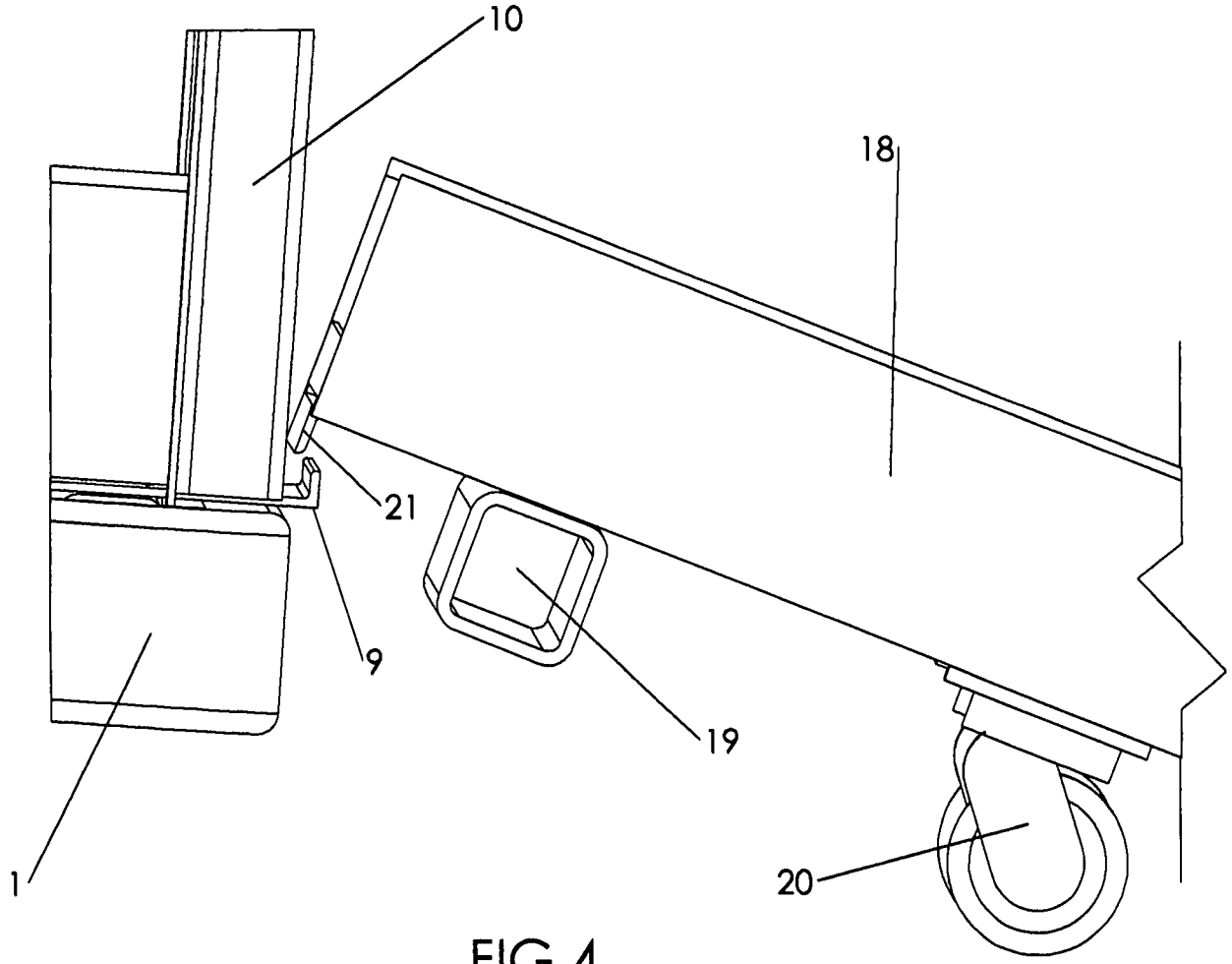
Figure 5:
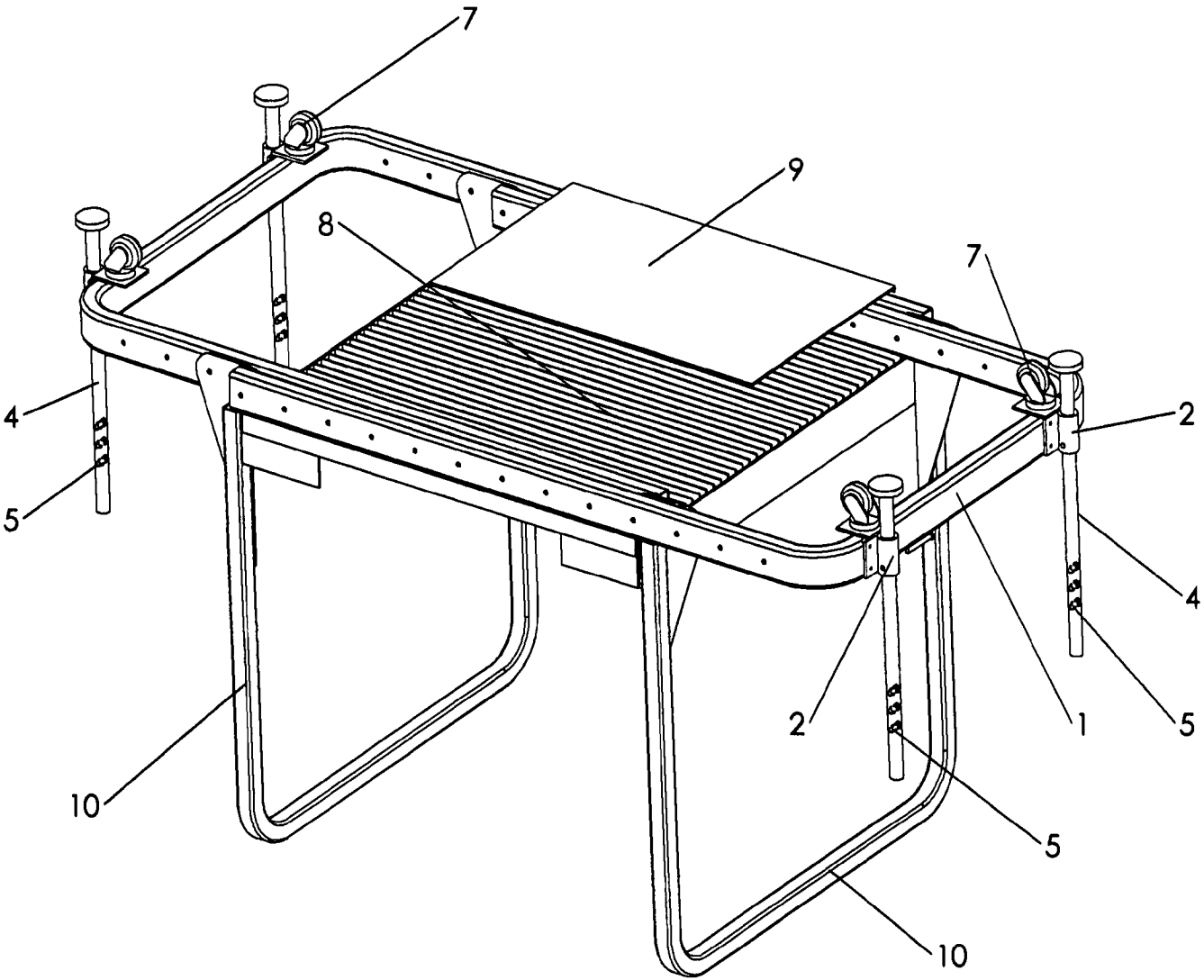
Figure 6:
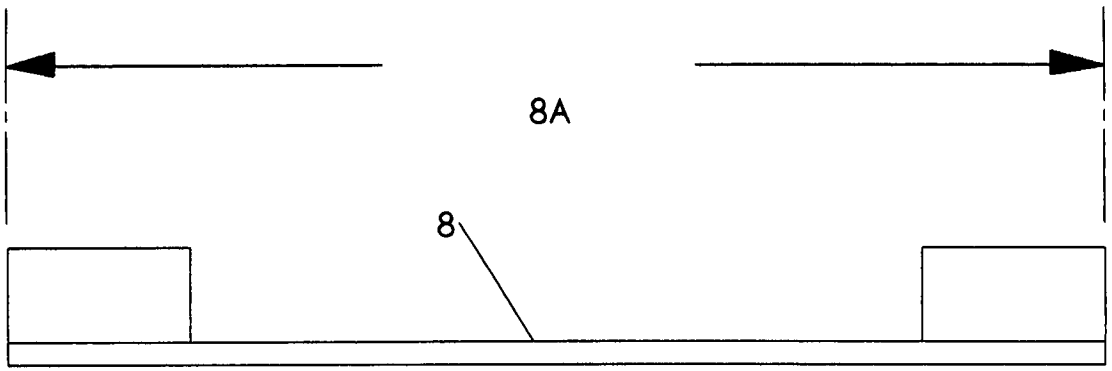
Figure 7:
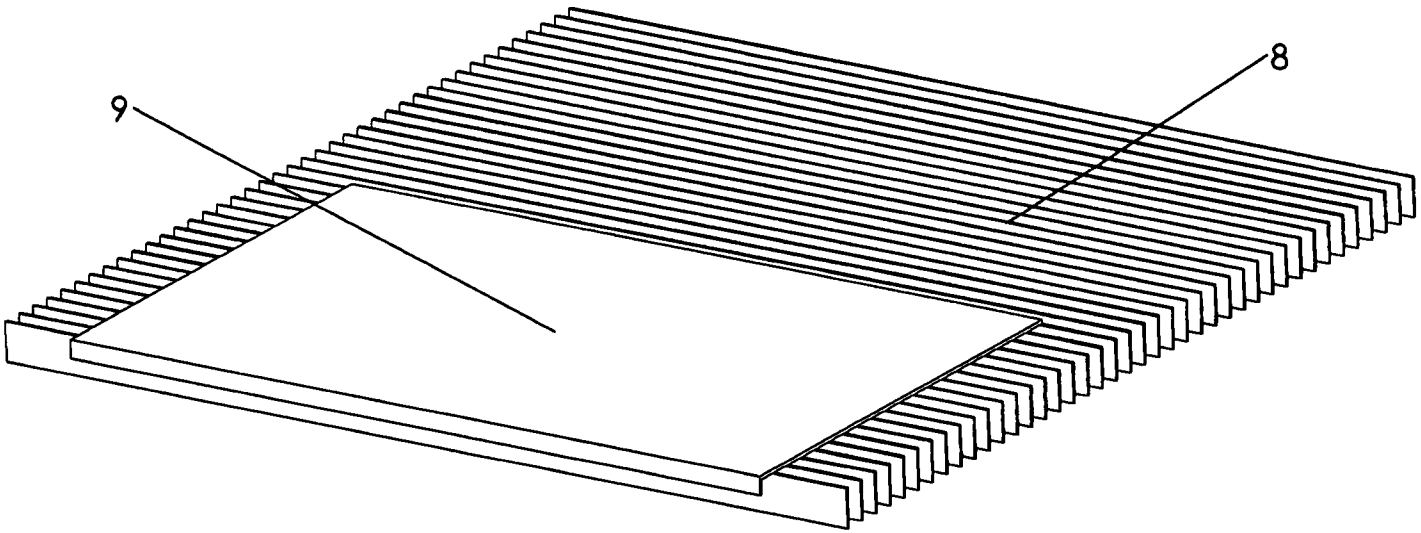
Figure 8:
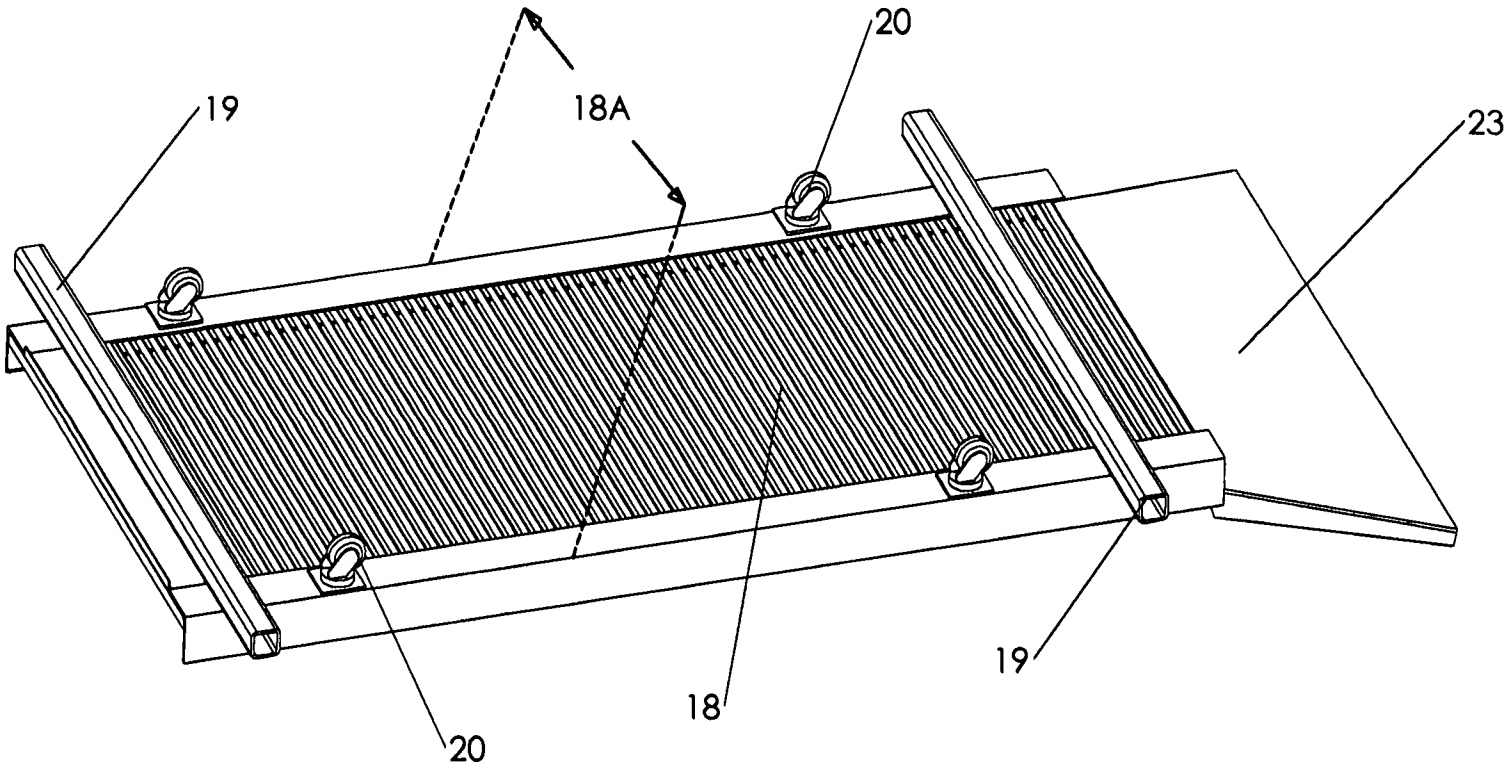
Figure 9:
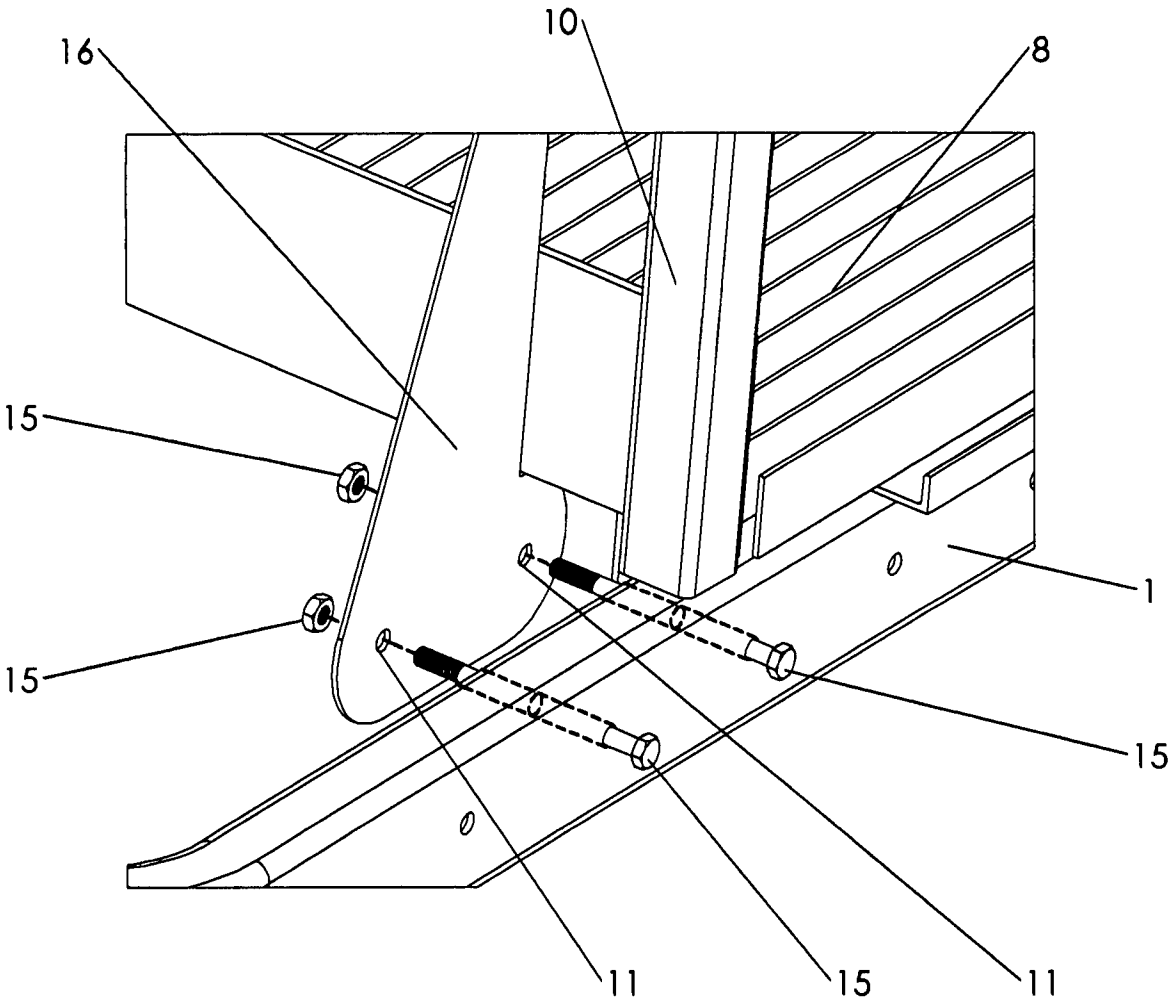

4. FIG. 4 shows the manner of assembly of the ramp unit of the invention to the platform unit thereof.
5. FIG. 5 is a perspective view showing affixation of wheel assembly units to the bottomside of the platform support unit of the invention.
6. FIG. 6 is a frontal plan view of the mounting platform of the invention.
7. FIG. 7 is a second isolated perspective view of the mounting platform of the invention featuring on the bottomside thereof the lipping component thereof.
8. FIG. 8 is an isolated perspective view featuring a portion of the bracing and wheel assembly unit affixed to the bottomside of the ramp unit of the invention.
9. FIG. 9 shows in isolated view a partially threaded bolt and threaded nut of a nut and bolt complex holding a brace portion of a support railing unit to the platform support unit.

Figure 9A:
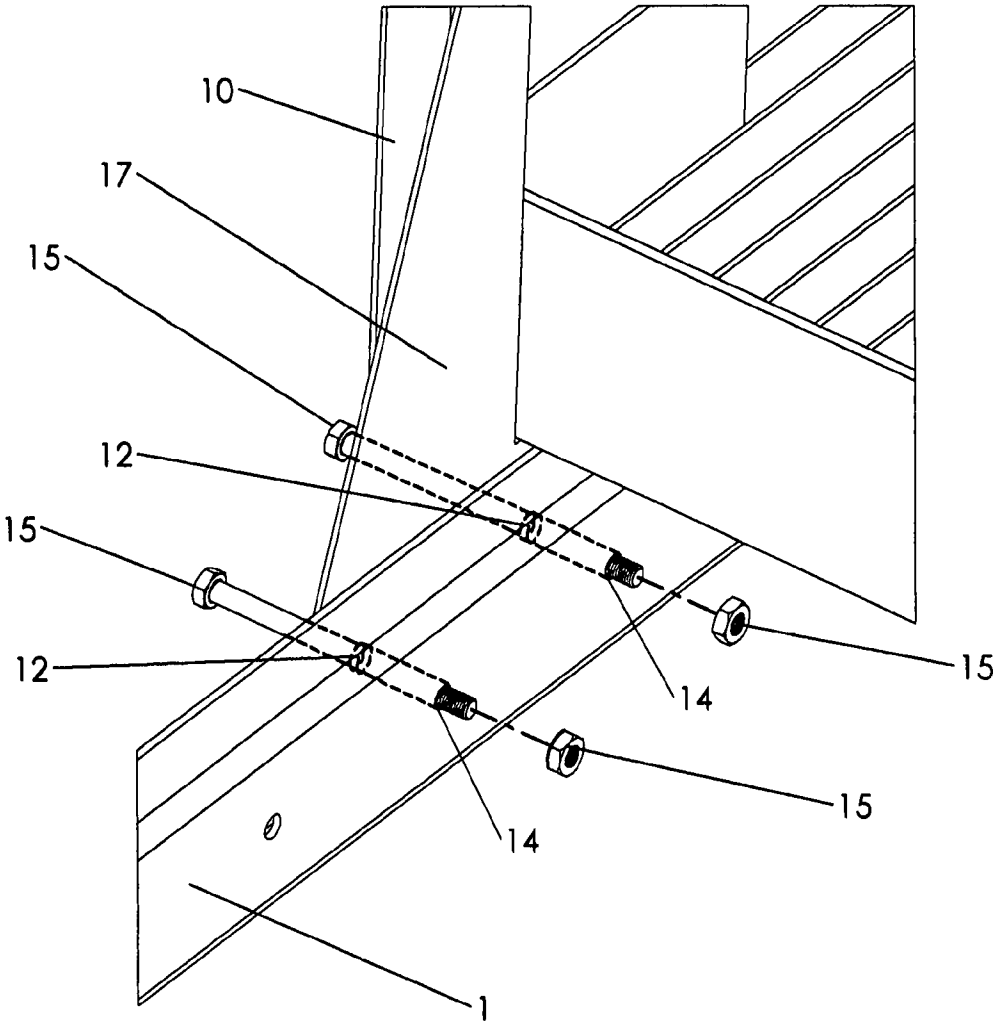

9A. FIG. 9A shows in isolated view a partially threaded bolt and threaded nut of another nut and bolt complex holding another brace portion of a support railing unit to the platform support unit.

Figure 10:
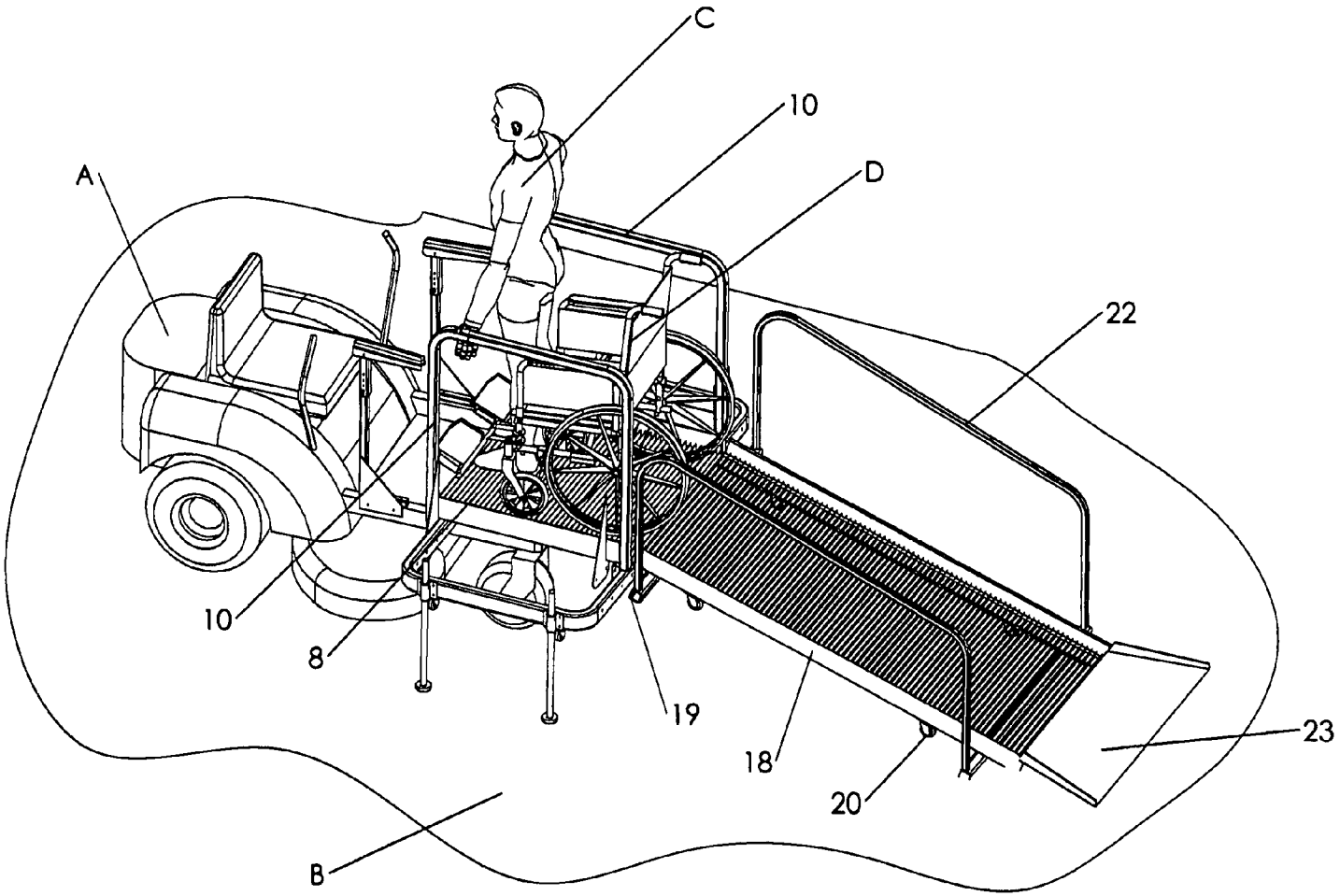
Figure 11:
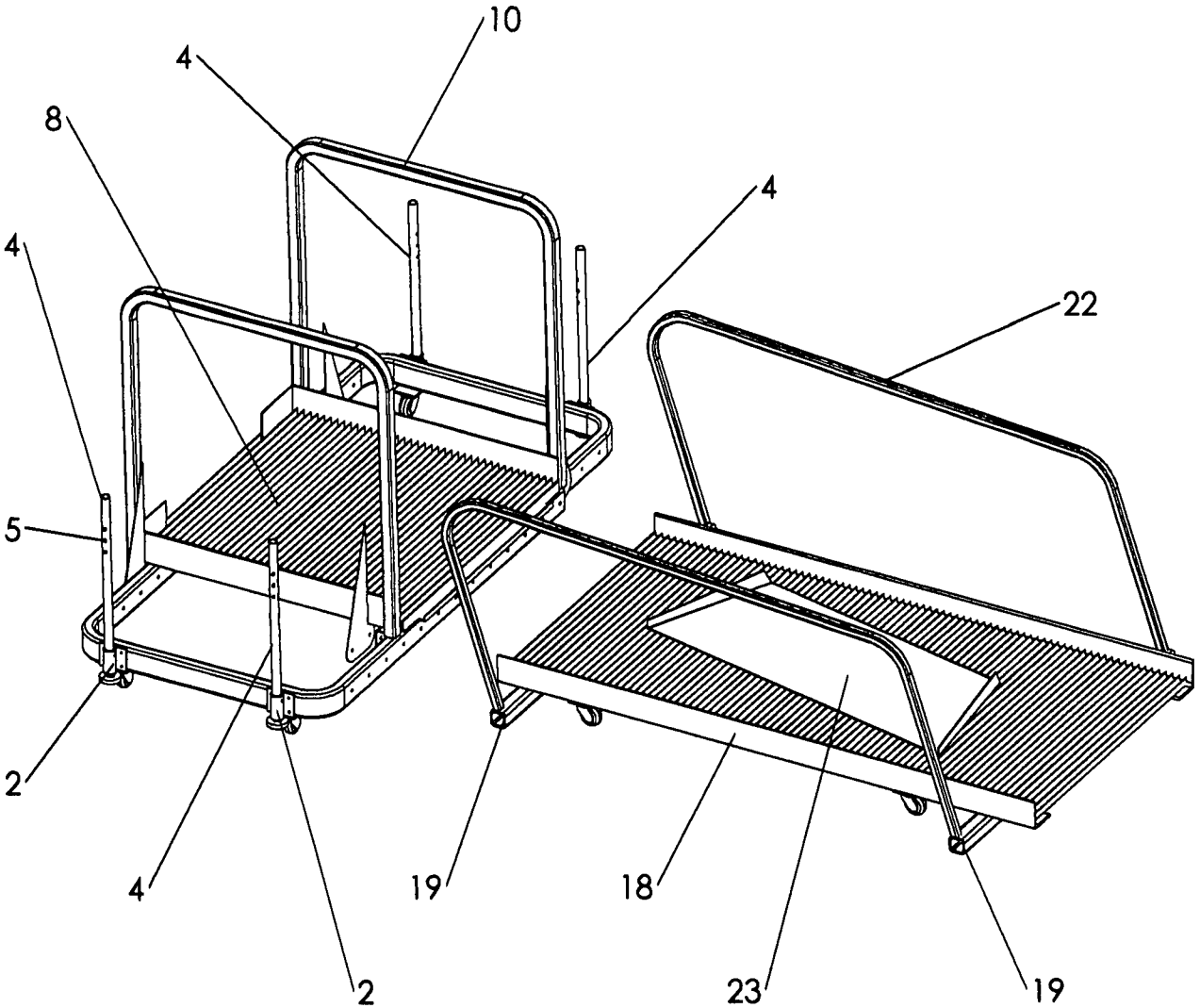

10. FIG. 10 shows a person utilizing the invention to mount a riding platform.
11. FIG. 11 shows the invention in a dissembled state in preparation for storage of the invention during non-use of the invention.

A DESCRIPTION OF THE PREFERRED EMBODIMENTS

FIG. 1 shows the fully assembled invention in apposition to a riding lawnmower A. The invention is made up of a rectangularly shaped reinforced platform support unit 1 featuring four laterally positioned leg compartment components 2 weldably affixed to unit 1 as seen in FIG. 1. Each compartment component 2 has a pair of concentric compartment holes 3 as seen in FIG. 2. There are four laterally positioned support leg units 4 each insertable within a compartment component 2. There is a plurality of through holes 5 in each leg unit 4 with each through hole 5 being concentric with holes 3 when the invention is fully assembled and in use. Each one of four pin units 6 being, for example, cotter pins or detent pins is insertable through holes 3 and 5 to hold leg units 4 securely within compartment components 2, and, in turn to hold support unit 1 at various height levels above any ground B. Two of such holes 3, two of such holes 5 in one of units 4 and one of pin units 6 are seen with particularity in FIG. 2. There are four equivalent wheel assembly units 7, each of which is affixed to the bottomside of support unit 1, each near a corner portion thereof as shown in FIG. 1 and with more particularity in FIG. 5. Resting atop unit 1 is multisided rectangularly shaped mounting platform 8 as shown in FIG. 5. The partially open anterior side portion of mounting platform 8 as evidenced with reference to FIG. 6 serves as a stop shield so as to prevent any person C in a wheelchair D accessing platform 8 from accidentally driving forwardly off from platform 8 and down onto a riding lawnmower A parked in front of and partially below the level of platform support unit 1 atop of which platform 8 is positioned when the then fully assembled invention is being sought to be utilized by such a person C as seen with reference to FIG. 10. Weldably affixed to the bottomside of platform 8 is lipping component 9 as can be seen with resort to FIG. 5 and more particularly with reference to FIG. 7. A pair of braced, arched support railings 10 are seen in FIG. 1. There is a plurality of first brace holes 11 and a plurality of second brace holes 12 each located in respective brace portions 16 and 17 of railings 10. There is a plurality of first support unit through holes 13 and a plurality of second support unit through holes 14. Holes 11 and 13 are concentric when railings 10 are assembled to unit 1 and in respect of such assembly, holes 11 and 13 receive partially threaded bolt portions of nut and bolt complexes 15 that serve to hold railings 10 to unit 1, once threaded nut portions of complexes 15 are turned fast onto the bolt portions thereof with the bolt portions thereof having previously been received by holes 11 and 13. Likewise, other complexes 15 serve to similarly hold railings 10 to unit 1 by way of bolt portions of such complexes 15 being receivable through holes 12 and 14. This mode of assembly of railings 10 to unit 1 can be seen with resort to FIG. 9 and also FIG. 9A. For a second embodiment of the invention, each of railings 10 are both weldably affixed at the brace portions 16 and 17 thereof to unit 1. Such weldable assembly of railings 10 to unit 1 thus eliminating any need for utilization of complexes 15 to accomplish any such assembly is appreciated with resort to a viewing of FIG. 3 and FIG. 3A. It is also the case that as respects both embodiments, the distance as between each of the railings 10 when assembled to unit 1 is of a length 10A as shown in FIG. 1. and is greater than the laterally sidewise breadth 8A of platform 8 as shown in FIG. 6 to thereby readily facilitate placement of platform 8 atop support unit 1 when the invention is in use by a person C seeking to mount a riding lawnmower A from a wheelchair D while lawnmower A is positioned on ground B in front and partially below support unit 1 of the fully assembled invention likewise positioned on ground B all as can be seen with resort to FIG. 10. The invention also features a multi-sided rectangularly shaped ramp unit 18 as seen, for example in FIG. 1. Ramp unit 18 is characterized by the presence of a pair of ramp undercarriage braces 19 and four ramp wheel assembly units 20, all of which are weldably affixed to the bottomside of ramp unit 18 as can be seen in FIG. 8. Braces 19, weldably affixed to the bottomside of ramp unit 18 provide more dependable support for a person C as he or she would be riding in a wheelchair D up ramp unit 18 after ramp unit 18 is affixed by way of insertion of downwardly extending, rectangularly shaped, metallic ramp plate unit 21 which is anteriorly welded to ramp unit 18, into L-shaped lipping component 9 weldably affixed to the bottom side of mounting platform 8, the upwardly extending portion of which component 9 extends upwardly just posterior enough from the backside of platform 8 to thereby readily accept plate unit 21, all of which can be appreciated with reference to FIG. 4. The laterally sidewise breadth 18A of ramp unit 18 shown in FIG. 8 is also less than length 10A referenced above. Optional ramp railing units 22 weldable at bottom edges thereof to superior portions of lateral ends of braces 19 are seen in FIG. 10 and FIG. 11. Units 22 serve to provide greater assurance to a person C against possibly driving of ramp 18 while a person C riding a wheelchair D up ramp 18 affixed, as noted above, to support unit 1. An optional trapezoidally shaped metallic off-ramp accessory unit 23 conjoinable with ramp unit 18 at a lowermost grounded portion of ramp unit 18 so as to facilitate more dependable access of a wheelchair D operated by a person C to ramp unit 18 from ground level B is shown in FIG. 10. The invention in a disassembled state and ready for storage is shown in FIG. 11.

In conclusion, the invention as described above readily enables a wheelchair bound person to dependably and safely mount a riding lawnmower from above rather than notably undependably and unsafely from the side of such a lawnmower. This distinctive feature of the invention, respectfully submitted, truly enables it to be viewed as a device that is indeed not only new but also as one that is unquestionably also highly useful and accordingly unique.

What is claimed is:

1. A wheelchair bound person's riding lawnmower mounting apparatus, comprising:

a. a rectangularly shaped reinforced metallic platform support unit with a plurality of pin insertion through holes located in each lateral side of said support unit;

b. four laterally positioned leg compartment components welded to said platform support unit;

c. a pair of concentric compartment holes in each of said compartment components;

d. four laterally positioned support leg units with each one of said leg units being insertable into one of said each of said compartment components;

e. a plurality of leg through holes in said each one of said support leg units;

f. each of said leg holes in said each of said support leg units being also amenable to being concentric with each of said compartment holes;

g. four metallic pin units, each one of which is insertable through any one of said compartment holes in said each of said compartment components and each of said leg through holes in each of said support leg units;

h. each one of four equivalent support unit wheel assembly units being weldably affixed near respective corner portions of a bottomside of said platform support unit;

i. a multi-sided rectangularly shaped metallic mounting platform removably positioned atop said platform support unit;

j. an L-shaped metallic platform lipping component welded to a bottomside of said mounting platform near a posterior side of said mounting platform;

k. a pair of braced, arched metallic support railings;

l. a first plurality of first brace holes within a first metallic brace portion of each of said braced, arched support railings;

m. a first plurality of first support unit through holes in said support unit;

n. each one of said first plurality of first brace holes being amenable to being concentric with one of each one of said first plurality of said first support unit through holes;

o. a second plurality of second brace holes within a second metallic brace portion of said each of said braced arched support railings;

p. a second plurality of second support unit through holes in said support unit;

q. each one of said second plurality of second brace holes being amenable to being concentric with one of each one of said plurality of said second support unit through holes;

r. a plurality of metallic threaded nut and partially threaded bolt complexes with each bolt portion of each one of said plurality of complexes being insertable through one each of said first plurality of first brace holes and one each of said plurality of said first support unit through holes as well as being insertable through one each of said second plurality of said second brace holes and one each of said plurality of said second support unit holes in affixation of each one of said railings to said support unit with a distance between each of said support railings so affixed to said support unit being in excess of a first lateral side to second lateral side breadth of said mounting platform;

s. a multisided rectangularly shaped metallic ramp unit with a first lateral side to second lateral side laterally sidewise breadth thereof being less than said distance between each of said support railings when said support railings are so affixed to said support unit;

t. each of a pair of undercarriage braces weldably affixed to a bottomside of said ramp unit;

u. each of four equivalent ramp wheel assembly units being weldably affixed to said bottomside of said ramp unit;

v. a downwardly extending rectangularly shaped metallic ramp plate unit weldably affixed to an anterior side of said ramp unit, and;

w. said plate unit being insertable into said lipping component.

2. The wheelchair bound person's riding lawnmower mounting apparatus of claim 1, whereby, a trapezoidally shaped metallic off-ramp accessory unit is conjoinable with said ramp unit at a lowermost grounded portion of said ramp unit when said ramp plate unit is inserted into said lipping component.

3. The wheelchair bound person's riding lawnmower apparatus of claim 1 whereby a pair of ramp railing units are each respectively welded at bottom edges thereof to respective topsides of each of said undercarriage braces near respective lateral ends of said each of said undercarriage braces.

4. A wheelchair bound person's riding lawnmower mounting apparatus, comprising:

a. a rectangularly shaped reinforced metallic platform support unit;

b. four laterally positioned leg compartment components welded to said platform support unit;

c. a pair of concentric compartment holes in each of said compartment components;

d. four laterally positioned support leg units with each one of said leg units being insertable into one said each of said compartment components;

e. a plurality of leg through holes in said each one of said support leg units;

f. each of said leg holes in said each of said support leg units being also amenable to being concentric with each of said pair of compartment holes;

g. four metallic cotter pins, each one of which is insertable through each of said pair of compartment holes in said each of said compartment components and each of said leg through holes in each of said support leg units;

h. each one of four equivalent support unit wheel assembly units being weldably affixed near respective corner portions of said platform support unit;

i. a multi-sided rectangularly shaped metallic mounting platform removably positioned atop said platform support unit;

j. an L-shaped metallic platform lipping component welded to a bottomside of said mounting platform near a posterior side of said mounting platform;

k. a pair of braced, arched metallic support railings;

l. a first metallic brace portion of each of said pair of braced, arched metallic support railings being welded anteriorly to an anterior portion of said support unit;

m. a second metallic brace portion of each of said pair of braced, arched metallic support railings being welded posteriorly to a posterior portion of said support unit;

n. a distance between each of said support railings so affixed being in excess of a first lateral side to a second lateral side breadth of said mounting platform;

o. a multisided rectangularly shaped metallic ramp unit with first lateral side to second lateral side breadth thereof being less than said distance between each of said support railings when said railings are so affixed to said support unit;

p. each of a pair of undercarriage braces weldably affixed to a bottomside of said ramp unit;

q. each of four equivalent ramp wheel assembly units being weldably affixed to said bottomside of said ramp unit;

r. a downwardly extending rectangularly shaped metallic ramp plate unit weldably affixed to an anterior side of said ramp unit, and;

s. said plate unit being insertable into said lipping component.

5. The wheelchair bound person's riding lawnmower mounting apparatus of claim 4, whereby, a trapezoidally shaped metallic off-ramp accessory unit is conjoinable with said ramp unit at a lowermost grounded portion of said ramp unit when said ramp plate unit is inserted into said lipping component.

6. The wheelchair bound person's riding lawnmower apparatus of claim 4 whereby a pair of ramp railing units are each respectively welded at bottom edges thereof to respective topsides of each of said undercarriage braces near respective lateral ends of each of said undercarriage braces.

* * * * *